United States Patent [19]

Kaelblein et al.

[11] 4,351,474

[45] Sep. 28, 1982

[54] MAILER WITH STICKER-TYPE SIGN

[75] Inventors: Robert Kaelblein, Springfield; John H. Jones, Westfield, both of N.J.

[73] Assignee: Beatrice Foods Co., Chicago, Ill.

[21] Appl. No.: 165,726

[22] Filed: Jul. 3, 1980

[51] Int. Cl.[3] ..... B65D 27/00

[52] U.S. Cl. ..... 229/68 R; 229/70; 282/25

[58] Field of Search ..... 229/70, 68 R; 282/22 R, 282/25; 281/3 R; 283/1 B, 18, 56

[56] References Cited

U.S. PATENT DOCUMENTS

| | | | |
|---|---|---|---|
| 2,180,551 | 11/1939 | Sawdon et al. | 229/68 R |
| 3,460,744 | 8/1969 | Turkenkopf | 229/68 R |
| 3,560,025 | 2/1971 | Ostrander | 229/68 R |
| 3,713,673 | 1/1973 | Katz | 229/68 R |
| 3,826,422 | 7/1974 | Dickinson | 229/68 R |
| 3,941,309 | 3/1976 | Gendron | 282/25 |
| 3,987,960 | 10/1976 | Gardiner | 282/25 |
| 4,034,910 | 7/1977 | Rogers | 229/68 R |

*Primary Examiner*—Stephen P. Garbe
*Attorney, Agent, or Firm*—Shlesinger, Arkwright, Garvey & Dinsmore

[57] ABSTRACT

A unitary mailer item has an envelope and an attached sticker-type sign piece, both of which are readily detachable from the item.

4 Claims, 3 Drawing Figures

MAILER WITH STICKER-TYPE SIGN

BACKGROUND OF INVENTION

This invention relates to mailer-type items, and particularly to a mailer which includes a return envelope and a removable type of self-adhering sticker-type sign piece, such as a bumper sticker.

Ordinarily, sticker-type pieces are provided as handouts for advertising purposes on an individual basis. It is much more effective to combine such a sticker with advertising material which is related to it, and in addition to provide it in a mailer format.

It has been found that combining the three elements of multiple advertising pages, a return envelope, and a sticker-piece provides a very effective advertising item.

FEATURES OF THE INVENTION

Accordingly, it is a principal feature of this invention to provide a unitary mailer item which includes an envelope and a detachable sticker-type sign for use by the person to whom it is distributed.

It is another feature of this invention to provide such a mailer as a low cost item which can be used in large numbers by advertisers.

An additional feature of this invention is the construction of the piece so that it can be made by high speed printing and folding machinery at low cost from a single web.

These and other features and objects of this invention will become apparent from the following description of the drawings.

DESCRIPTION OF THE INVENTION

Figure 1:
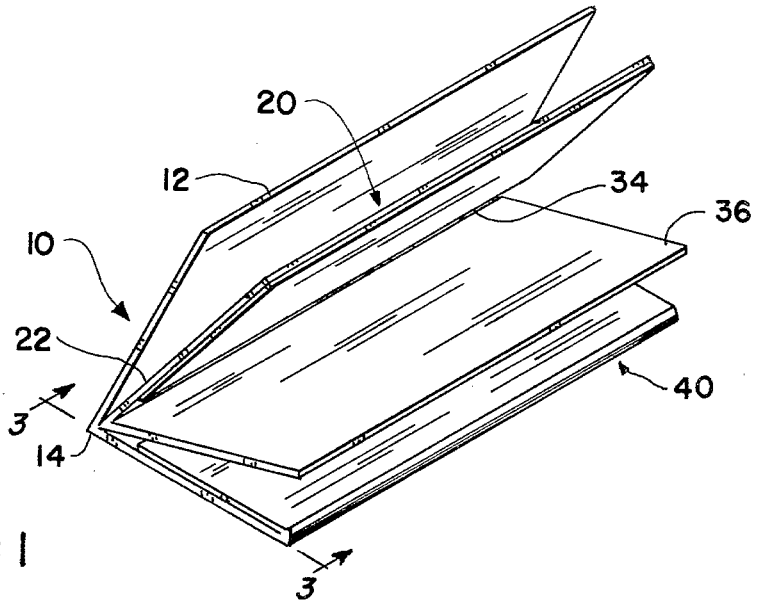
FIG. 1 is a perspective view of the mailer of this invention.
Figure 2:
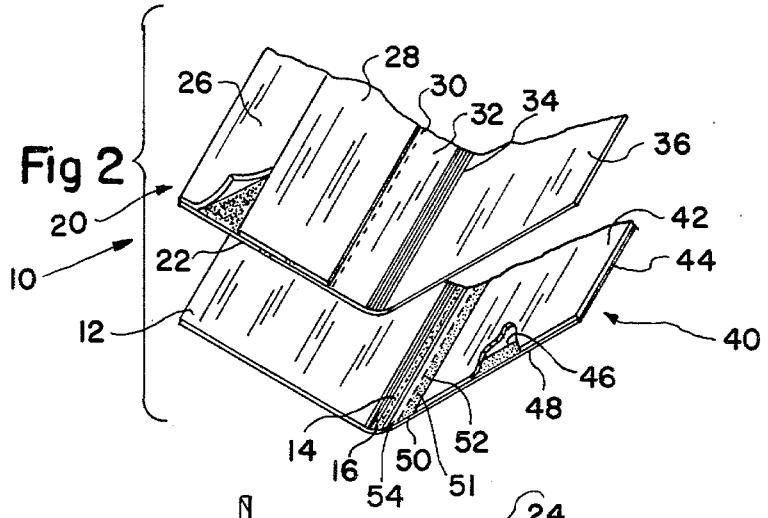
FIG. 2 is an exploded end view of the item.

Referring to the drawings, 10 indicates the mailer item which has a printed plain panel 12 extending outwardly from the mailer central fold line 14. A strip of binding glue 16 holds the rectangular sticker panel, generally indicated at 20, to panel 12.

The sticker panel section 22 has printing on one side and backing adhesive 24 on the reverse side. Two peel-off strips 26 and 28 cover and protect the glue side of the sticker. The perforated line 30, at the inner fixed periphery of the sticker-sign 20, provides a means of separating it from the sticker retaining strip 32 which extends between the perforated separating line 30 and the fold like 34 of the mailer 10.

In the modification shown, an additional plain printed panel 36 is disposed beside the sticker section, in addition to the printed panel 12.

Figure 3:
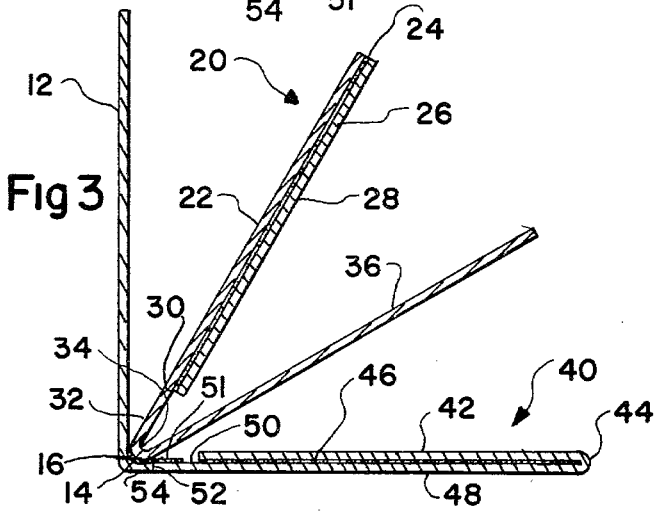
FIG. 3 is a sectional view taken along lines 3—3 of FIG. 1.

The lowermost element of the shown mailer item is a return envelope, generally indicated at 40. It has an inner short panel 42 folded about the fold line 44 and over panel 48. The fold line 44 then forms the bottom edge of the envelope. Both panels 42 and 48 are held together by parallel end glue strips 46 at each side edge of the envelope, one of which is shown in section in FIG. 3. Lower envelope panel 48 is integral with a flap section 50 which has a long strip of remoistenable glue 51 (FIG. 3) extending across its width and clear of inside panel 42. Immediately adjacent the periphery of the envelope flap 50 is a perforated line 52 which permits the envelope to be separated from an envelope retaining section 54 adjacent the central fold line 14.

One of the advantages of this mailer item is that it can readily be made on high speed printing and folding machinery from a single web. In the manufacture of this mailer, the printing for the several elements of the piece is completed as a first step. Subsequently contact glue is applied to the sticker-label reverse side and remoistenable glue 51 applied to the envelope flap section. Quick drying contact glue is applied as envelope holding strips for the the two envelope panels. This is done in a continuous operation as each section of the web progresses from the printing to gluing and strip applying section of the in line manufacture machinery. After this operation and prior to folding, the perforated lines 30 and 52 are cut in the web.

The web, although not shown, is folded inwardly from each edge at very high speed, and then folded over into the several components of the finished piece.

For example, in one arrangement for making the mailer item disclosed in this application, on viewing the web on end, as it approaches from the printing and glue drying apparatus (with reference to the end view of FIG. 3), the righthand edge of the web would include the edge of the envelope panel 42. It is folded about line 44 so that the basic envelope is formed when panel 42 is folded over panel 48 down so that the glue strips 46 at each end of the envelope section engage and hold the two panels 42 and 48 together.

The far left end of the web, including printed panel 36, is then folded over on top of the performed envelope sections, and this brings the glue strip 16 into contact with the approximately evenly divided web halves to hold them together.

The entire web is then folded a second time at about the location of the central fold lines 14 and 34. This brings the sticker panel section and plain panel 12 over on top of plain printed panel 36 and envelope 40. The fold line adjacent the outer periphery of panel 12 and sticker panel 20 are then removed by cutting off the edge to open up and free panel 12 from sticker panel 20. After the folding operation, the successive pieces are cut transversely and separated from the web.

While this invention has been described, it will be understood that it is capable of further modification, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

What is claimed is:

1. A mailer for sticker-type signs, comprising:

(a) a rectangular mailer envelope having two panels folded along a common fold line to form the envelope bottom edge and the two adjacent side envelope edges being held together by glue strips, (b) one of the panels being wider than the other and having a flap section containing a strip of remoistenable glue, (c) an elongated thin envelope retaining section disposed immediately adjacent the envelope flap section, (d) a perforated line disposed between the envelope retaining section and the envelope flap section which permits the envelope to be separated from the envelope retaining section, (e) an elongated sticker-retaining strip integrally connected to the envelope retaining section, (f) a rectangular sticker disposed immediately adjacent the sticker-retaining strip, (g) a perforated line disposed between the sticker-retaining strip and the sticker which permits the sticker to be separated from the sticker-retaining strip, (h) the sticker having printing disposed on one side thereof and backing adhesive on the other, and (i) a peel-off strip covering the backing adhesive on the sticker panel.

2. The mailer for sticker-type signs as set forth in claim 1, wherein:

(a) a printed panel is integrally connected to one of the retaining elements, and (b) the printed panel, sticker, and mailer envelope are positioned in superposed relation with respect to each other.

3. The mailer for sticker-type signs as set forth in claim 2, wherein:

(a) the printed panel is part of a single sheet with the sticker, and (b) a fold line separates it from the sticker retaining strip.

4. The mailer for sticker-type signs as set forth in claim 2, wherein:

(a) the printed panel is part of a single sheet with the sticker, and (b) a fold line separates it from the envelope retaining section.

* * * * *